US006494709B1

(12) United States Patent
Li

(10) Patent No.: US 6,494,709 B1
(45) Date of Patent: Dec. 17, 2002

(54) DISPOSABLE LIGHTER WITH CHILD RESISTANT DEVICE

(76) Inventor: Wen Qian Li, 3440 Lebon Dr., San Diego, CA (US) 92122

( * ) Notice: Subject to any disclaimer, the term of this patent is extended or adjusted under 35 U.S.C. 154(b) by 0 days.

(21) Appl. No.: 10/032,679

(22) Filed: Oct. 24, 2001

(51) Int. Cl.[7] ..... F23D 11/36; F23Q 1/02
(52) U.S. Cl. ..... 431/153; 431/277
(58) Field of Search ..... 431/153, 277, 431/255, 271, 276, 273

(56) References Cited

U.S. PATENT DOCUMENTS 5,096,414 A * 3/1992 Zellweger ..... 431/277
5,882,186 A * 3/1999 Man ..... 431/153
6,123,541 A * 9/2000 Yang ..... 431/153
6,142,768 A * 11/2000 Feng ..... 431/153

* cited by examiner

*Primary Examiner*—James C. Yeung
(74) *Attorney, Agent, or Firm*—Raymond Y. Chan; David and Raymond Patent Group

(57) ABSTRACT

A child resistant device, incorporated with a disposable lighter, includes a pair of shelter wheels, each having a U-shaped cross section, supported on two sides of two driving wheels respectively and partially covering circumferential teeth surfaces of the two driving wheels respectively to define an actuating edge at an uncovered portion of the circumferential teeth surface of each of the driving wheels. Therefore, the disposable lighter only allows an adult's thumb to press on the shelter wheels until the surface skin of the adult's thumb contact with the actuating edges to rotate the driving wheels so as to ignite the disposable lighter.

8 Claims, 5 Drawing Sheets

DISPOSABLE LIGHTER WITH CHILD RESISTANT DEVICE

BACKGROUND OF THE PRESENT INVENTION

1. Field of Invention

The present invention relates to a disposable lighter, and more particularly to a disposable lighter employed with a child resistant device for preventing under age children from igniting the disposable lighter.

2. Description of Related Arts

Commercially available disposable lighters are dangerous if users are handle carelessly, especially by young children. The inadvertent ignition of such disposable lighters may result in fires causing property damage and injury to people. Therefore, there is a need for a safety device that prevents inadvertent ignition of the disposable lighter or makes the lighters difficult for children to operate.

In response to the demands for a disposable lighter which is improved in safety in such a manner that inadvertent and unintentional ignition by those who are unfamiliar with the proper use of the lighter can surely be prevented. Childproof disposable lighters having different types of child resistant device have already been known.

There are two common kinds of a child resistant device. One kind of the child resistant device comprises a pair of driving caps coaxially and rotatably mounted at two outer sides of a striker wheel in an idle manner, such as U.S. Pat. Nos. 5,655,902; 5,096,414; 6,074,198; 5,997,281; and 5,846,069. In order to prevent the ignition of the lighter, clearance is provided between an outer circumferential surface of the striker wheel and the respective driving cap such that an adult user must apply a relative large force to press his or her thumb downwards until his or her thumb is in contact with and rub against the outer circumferential surface of the striker wheel. However, due to the idling design of the driving caps, the driving caps may easily to slip sideward, so as to misalign with the striker wheel. Therefore, the user's thumb may merely get cut by the shape edge of the driving cap while igniting the lighter. Moreover, when an external matter, such as sand or tiny stone, enters to the clearance between the driving cap and the striker wheel, the driving cap is stunk with the striker wheel, which may loss the ordinary safety feature of the driving cap. In other words, the design of such driving cap cannot provide 100% safety feature for the disposable lighter.

Another kind of the child resistant device comprises a pair of protection discs coaxially mounted at two outer sides of a striker wheel, such as U.S. Pat. Nos. 5,769,625; 5,897,307; and 5,882,186, wherein each of the protection discs has an outer glossy circumferential surface for reducing a friction thereof, such that the child's thumb will easily slip off on the protection discs, so as to prevent the lighter from being ignited by the child. However, such protection discs are somewhat difficult in operation for an adult user. The adult user must apply a relative large force to press his or her thumb downwards until his or her thumb is in contact with and rub against the outer circumferential surface of the striker wheel. Thus, the residue on the striker wheel may stick the user' thumb after every ignition of the lighter. Therefore, the user's thumb may feel painful and dirty his or her thumb as well.

Besides, a common drawback of the two kinds of child resistant device as mentioned above is that the lighter must be required to alter the structure of the ignition wheel assembly in order to fittedly mount the driving caps or the protective caps to the striker wheel. Due to the different safety standards between the United States and other foreign countries, the manufacturer of the lighter must change the design of the child resistant device in order to meet the safety requirement of each country. Therefore, the manufacturing cost of the disposable lighter will be highly increased, which will loss the ordinary inexpensive feature of the disposable lighter.

SUMMARY OF THE PRESENT INVENTION

A main object of the present invention is to provide a disposable lighter employed with a child resistant device does not require to alter the original structure of the disposable lighter.

Another object of the present invention is to provide a disposable lighter employed with a child resistant device for preventing under age children from igniting the disposable lighter.

Another object of the present invention is to provide a disposable lighter employed with a child resistant device, wherein the ignition of the disposable lighter of the present invention requires a simple single-action operation by an adult's thumb.

Another object of the present invention is to provide a disposable lighter employed with a child resistant device which is adapted to be easily installed to all kinds of disposable lighter having a striker wheel.

Another object of the present invention is to provide a disposable lighter employed with a child resistant device, wherein no expensive or complicate structure is required to employ in the present invention in order to achieve the above mentioned objects. Therefore, the present invention successfully provides an economic and efficient solution for preventing the ignition of the disposable lighter accidentally and unintentionally by the children.

Accordingly, in order to accomplish the above objects, the present invention provides a disposable lighter, comprising:

a lighter body for receiving a liquefied fuel therein;

a mounting frame, which is sealedly affixed on top of the lighter body, comprising a first and a second supporting walls integrally, parallelly and longitudinally extended from two sides of the mounting frame, the mounting frame further having a vertical spring chamber between the first and second supporting walls;

a spring being received in the spring chamber;

a gas lever being pivotally mounted between the first and second supporting walls and having a central cutout to allow the spring penetrating therethrough to insert into the spring chamber, the gas lever further integrally providing a thumb pusher at one end thereof;

a gas valve with a gas nozzle extending upwards above the mounting frame being installed inside the mounting frame, the gas nozzle being engaged with another end of the gas lever, so that when the thumb pusher is pushed downwardly, the another end of the gas lever lifts the gas nozzle to release gas from an interior of the lighter body via the gas valve;

an ignition device, which comprises a flint having a bottom portion inserting into the spring chamber and being supported by the spring, a striker wheel having a circumferential coarse striking surface positioned right above the flint being rotatably mounted between the first and second supporting walls by means of a wheel axle, and two driving wheels coaxially attached at two sides of the striker wheel respectively, wherein each of the driving wheels has a circumferential teeth surface and a diameter larger than a diameter of the striker wheel; and a child resistant device which comprises a pair of shelter wheels each including a protection disc connected integrally with a shelter ring extending perpendicularly from a circular edge of the protection disc so as to define a U-shaped cross section for each of the shelter wheels, each of the protection discs having a center hole for the wheel axle passing through so as to supportively position the two protection discs at two sides of the two driving wheels respectively, wherein an inner diameter of the shelter ring is larger than an outer diameter of the driving wheels so as to define safety gap between an inner circumferential surface of the shelter ring and the circumferential teeth surface of each of the driving wheels, wherein the two shelter rings are substantially extended to partially cover the circumferential teeth surfaces of the two driving wheels respectively, each of the two shelter rings having a width shorter than a thickness of each of the driving wheels, so as to define an actuating edge at an uncovered portion of the circumferential teeth surface of each of the driving wheels.

In order to ignite the disposable lighter, an adult's thumb must be intentionally press on the shelter wheels downward until his or her thumb's surface skin is in contact with the actuating edges of the driving wheels through the safety gaps. Meanwhile, by rotating the driving wheels, the striker wheel is driven to be rotated to ignite the disposable lighter.

DETAILED DESCRIPTION OF THE PREFERRED EMBODIMENT

Figure 1:
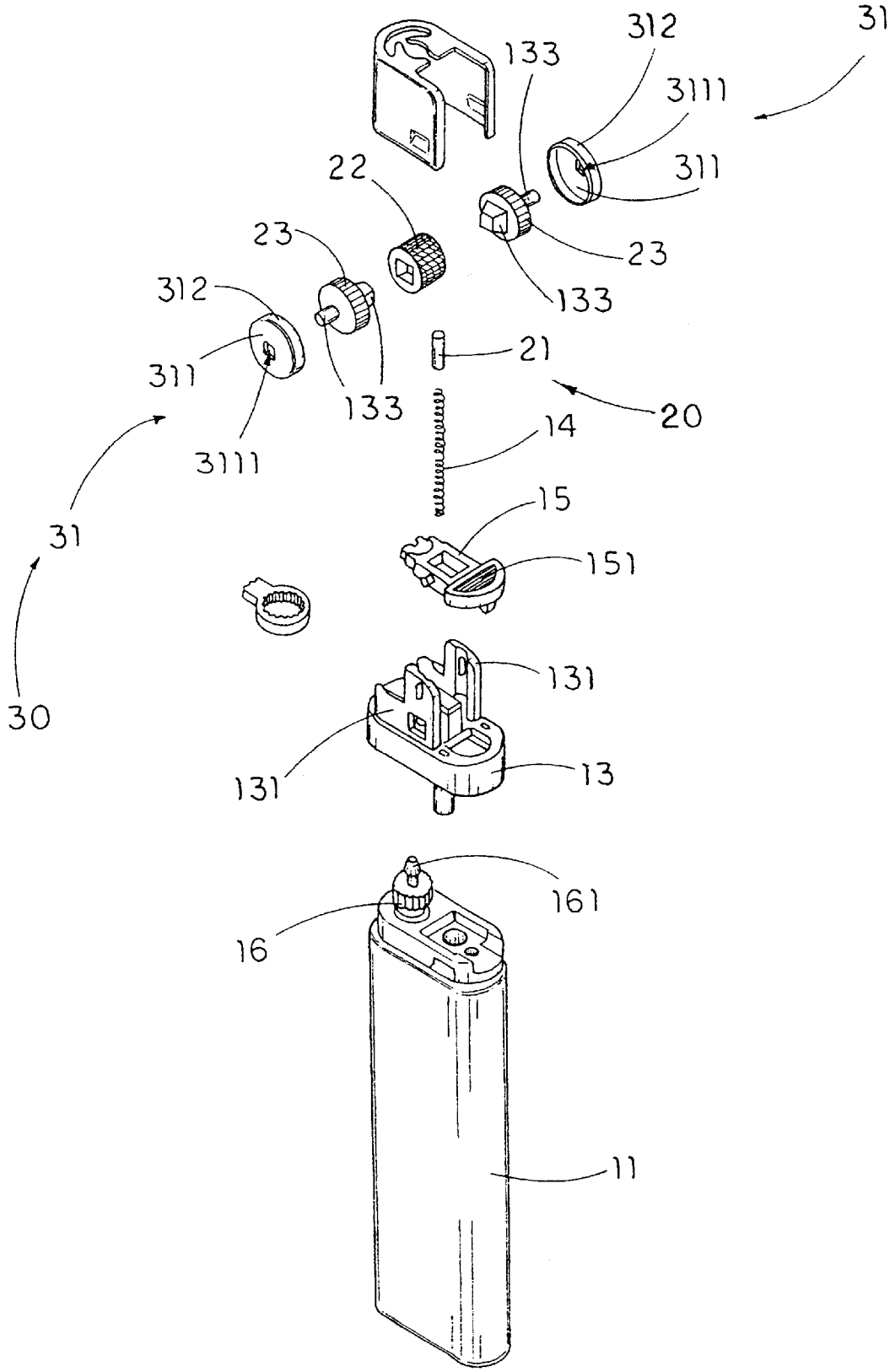
FIG. 1 is an exploded perspective view of a disposable lighter employed with a child resistant device according to a preferred embodiment of the present invention.
Figure 2:
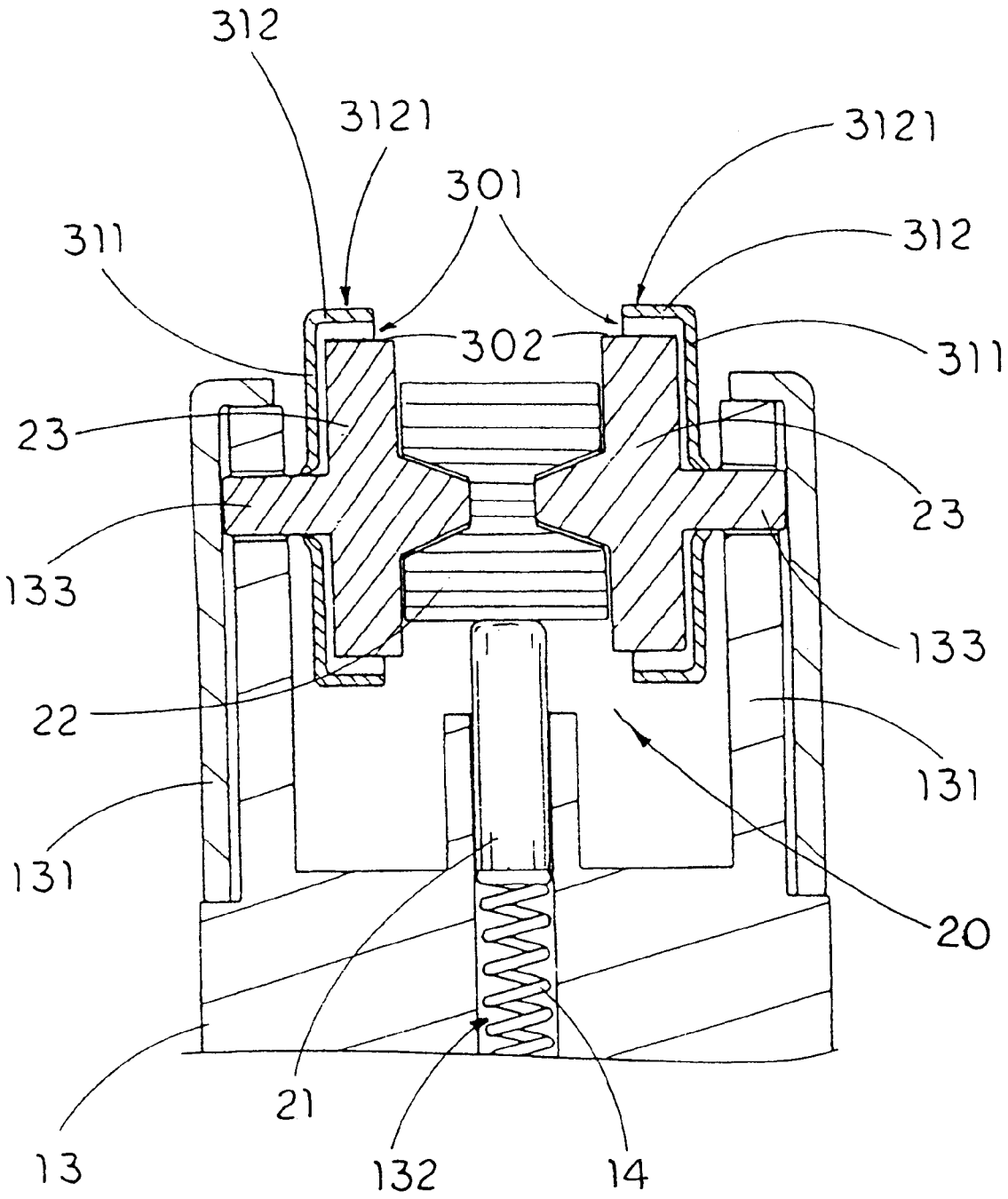
FIG. 2 is a sectional view of the child resistant device for the disposable lighter according to the above preferred embodiment of the present invention.

Referring to FIGS. 1 and 2 of the drawings, a disposable lighter 10 employed with a child resistant device 30 according to a preferred embodiment of the present invention is illustrated. The disposable lighter 10, such as a standard disposable lighter, a lighter body 11 for receiving a liquefied fuel therein, a mounting frame 13, which is sealedly affixed on top of the lighter body 11, comprising a first and a second supporting walls 131 integrally, parallelly, and longitudinally extended from two sides of the mounting frame 13. The mounting frame 13 further has a vertical spring chamber 132 between the first and second supporting walls 131 wherein a spring 14 being received in the spring chamber 132.

The disposable lighter 10 further comprises a gas lever 15 being pivotally mounted between the first and second supporting walls 131 and having a central cutout to allow the spring 14 penetrating therethrough to insert into the spring chamber 132, wherein the gas lever 15 further integrally provides a thumb pusher 151 at one end thereof. A gas valve 16 with a gas nozzle 161 is extended upwards above the mounting frame 13 and is installed inside the mounting frame 13 wherein the gas nozzle 161 is engaged with another end of the gas lever 15, so that when the thumb pusher 151 is pushed downwardly, the another end of the gas lever 15 lifts the gas nozzle 161 to release gas from an interior of the lighter body 11 via the gas valve 16.

The disposable lighter 10 further comprises an ignition device 20, which comprises a flint 21 having a bottom portion inserting into the spring chamber 132 and being supported by the spring 14, a striker wheel 22 having a circumferential coarse striking surface positioned right above the flint 21 being rotatably mounted between the first and second supporting walls 131 by means of a wheel axle 133, and two driving wheels 23 coaxially attached at two sides of the striker wheel 22 respectively, wherein each of the driving wheels 23 has a circumferential teeth surface and a diameter larger than a diameter of the striker wheel 22.

The driving wheels 23 are arranged to drive the striker wheel 22 to rotate simultaneously when the driving wheels 23 are rotated in such a manner that the striker wheel 22 will strike against the flint 21 to generate spark for igniting the gas released from the gas nozzle 161.

The child resistant device 30 comprises a pair of shelter wheels 31 each including a protection disc 311 connected integrally with a shelter ring 312 extending transversally from a circumferential edge of the protection disc 311 to define a U-shaped cross section for each of the shelter wheels 31.

According to the preferred embodiment, each of the protection discs 311 has a center hole 3111 for the wheel axle 133 passing through so as to supportively position the two protection discs 311 at two sides of the two driving wheels 23 respectively wherein in inner diameter of the shelter ring 312 is larger than an outer diameter of the driving wheels 23 so as to define safety gap 301 between an inner circumferential surface of the shelter ring 312 and the circumferential teeth surface of each of the driving wheels 23.

The two shelter rings 312 are substantially extended to partially cover the circumferential teeth surfaces of the two driving wheels 23 respectively wherein each of the two shelter rings 312 has a width shorter than a thickness of each of the driving wheels 23, so as to define an actuating edge 302 at an uncovered portion of the circumferential teeth surface of each of the driving wheel 23.

As shown in FIG. 3, the two shelter wheels 31 are positioned at two outer sides of the driving wheels 23 respectively wherein the shelter rings 312 are extended towards the striker wheel 22 to cover the circumferential teeth surfaces of the two driving wheels 23 respectively such that the two actuating edges 302 are formed at two inner edge portions of the circumferential teeth surfaces of the two driving wheels 23 respectively.

Accordingly, each center hole 3111 of the protection disc 311 has a square shape and a size slighter smaller than a diameter of the wheel axle 133 in such a manner that when the wheel axle 133 passes through the center hole 3111, a circumferential edge of the center hole 3111 is forced to distort a shape thereof so as to fit to the wheel axle 133. In other words, the shelter wheels 31 are securely mounted on the wheel axle 133 for preventing a misalignment of each of the shelter wheels 31 with respect to each of the driving wheels 23 so as to maintain the safety gap 301 having a predetermined distance.

Each of the shelter rings 312 has an outer smooth circumferential surface 3121 for reducing a friction thereof such that the child's thumb will easily slip off the outer smooth circumferential surfaces 3121 of the shelter rings 312 so as to further enhance the child resistant feature.

Figure 4A:
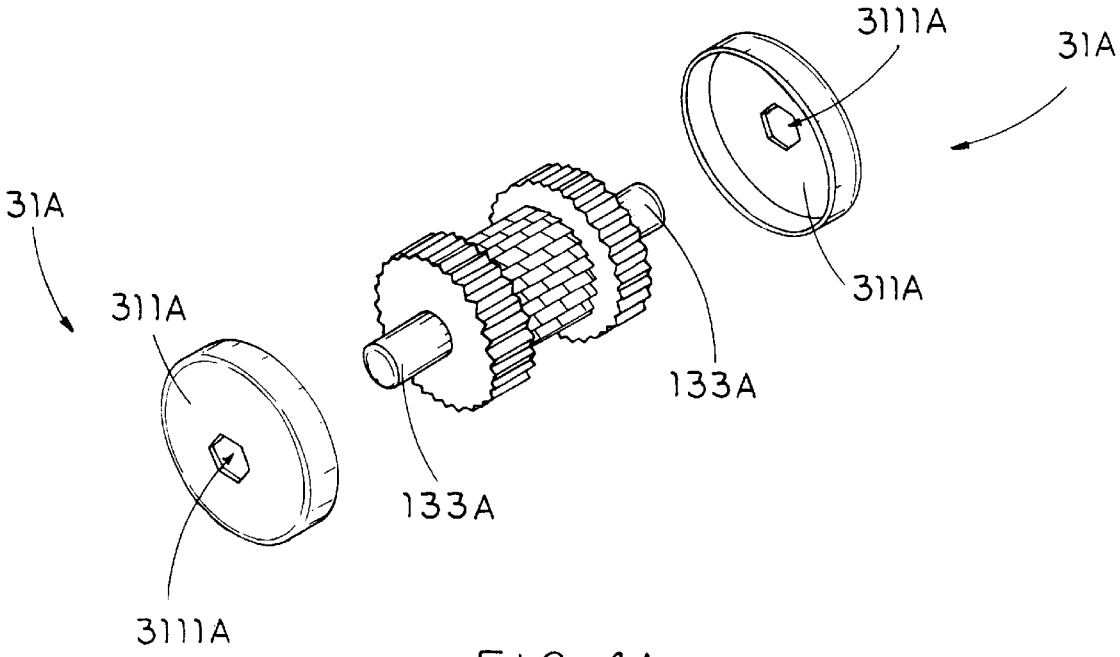
FIGS. 4A and 4B illustrate alternative modes of a shelter wheel of the child resistant device according to the above preferred embodiment of the present invention.
Figure 4B:
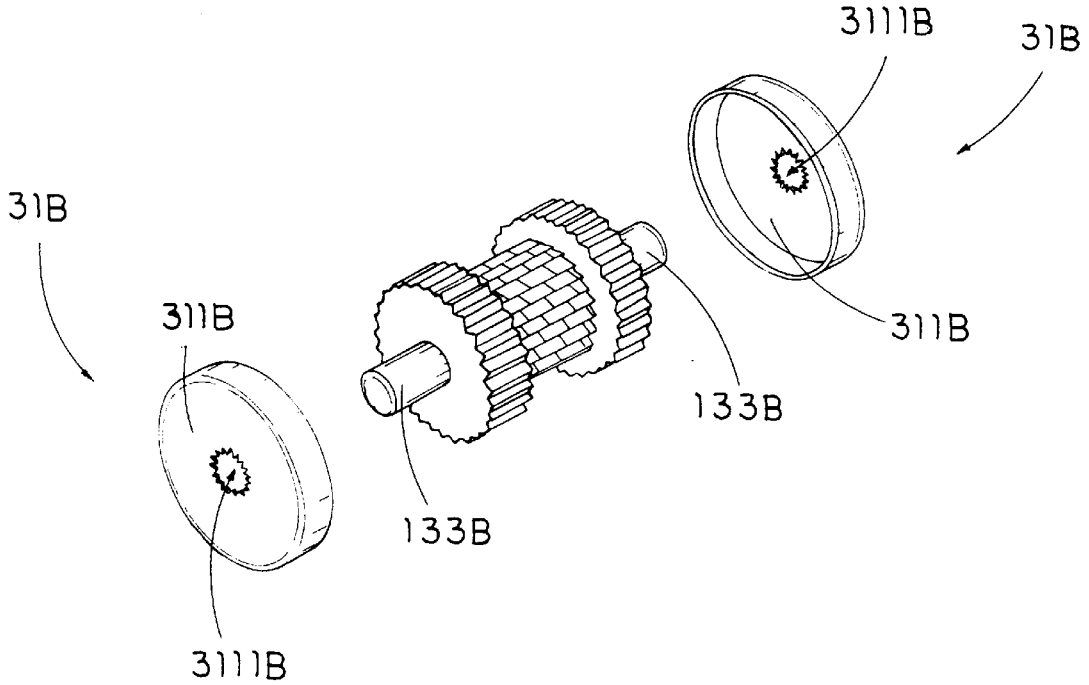

FIGS. 4A illustrates a first alternative mode of the protection disc 311A of the shelter wheel 31A, wherein each center hole 3111A of the protection discs 311A having a polygon shape has a size slighter smaller than a diameter of the wheel axle 133A in such a manner that when the wheel axle 133A passes through the center hole 3111, a circumferential edge of the center hole 3111A is forced to distort a shape thereof so as to fit to the wheel axle 133A. Similarly, each center hole 3111B of the protection discs 311B having a saw-toothed shape has a size slighter smaller than a diameter of the wheel axle 133B, which can achieve the securely mounting purpose as mentioned above.

Figure 3A:
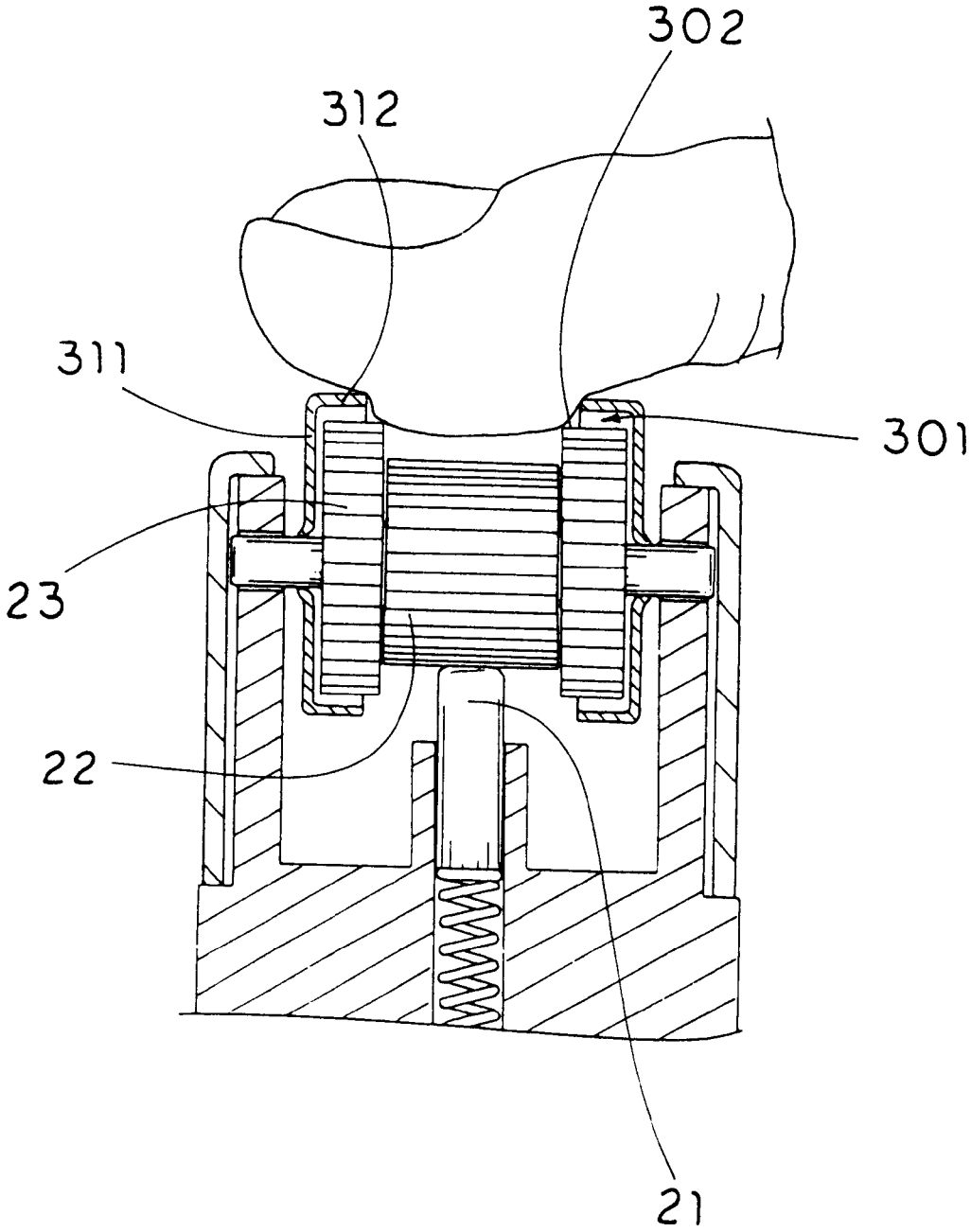
FIG. 3A is a side view of the child resistant device for the disposable lighter according to the above preferred embodiment of the present invention, illustrating the child resistant device allowing an adult's user from ignition.
Figure 3B:
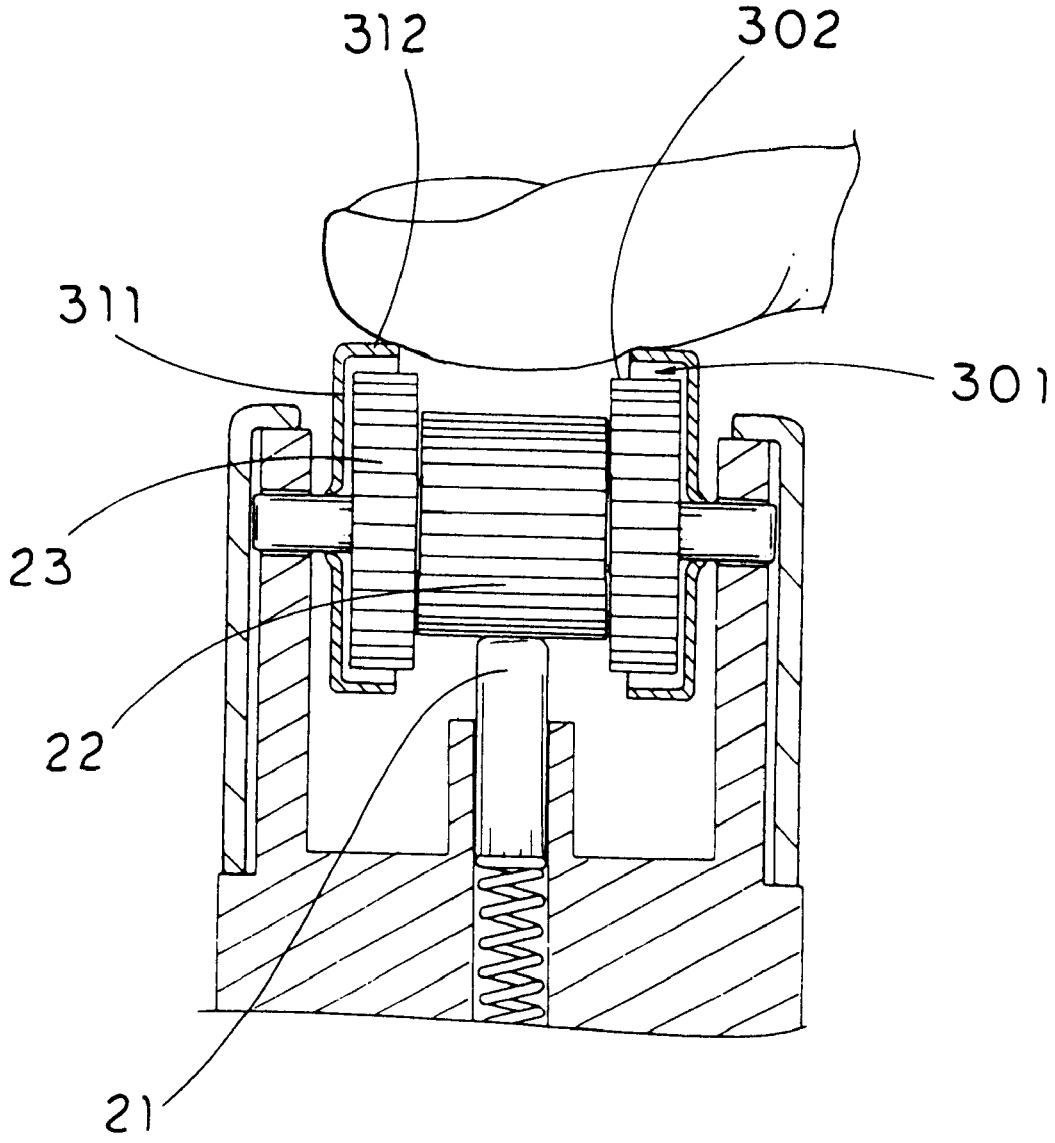
FIG. 3B is a side view of the child resistant device for the disposable lighter according to the above preferred embodiment of the present invention, illustrating the child resistant device stopping a child from ignition.

In order to ignite the disposable lighter 10, an adult's thumb must be intentionally press on the shelter wheels 31 downward until his or her thumb's surface skin is in contact with the actuating edges 302 of the driving wheels 23 through the safety gaps 301, as shown in FIG. 3A. Meanwhile, by rotating the driving wheels 23, the striker wheel 22 is driven to be rotated to ignite the disposable lighter 10. However, the child's thumb is not big enough to deform in order to contact with the actuating edges 302 of the driving wheels 23 through the safety gaps 301, as shown in FIG. 3B, so that the child is unable to rotate the driving wheels 23 to ignite the disposable lighter 10. Moreover, the adult's thumb will only contact the driving wheels 23 but not the striker wheel 22 such that no residue on the striker wheel 22 will stick the adult's thumb after every ignition of the disposable lighter 10.

It is worth to mention that the disposable lighter 10 as mentioned above is a conventional disposable lighter wherein when the disposable lighter 10 is employed with the child resistant device 30, the disposable lighter 10 will achieve the safety feature that prevents not only the ignition from the children but also an unintentional ignition from the adult's user. Thus, no original ignition structure of the disposable lighter is required to be altered and no expensive or complicate part is needed to added into the lighter, so as to minimize the manufacturing cost and assembly cost of the disposable lighter of the present invention.

What is claimed is:

1. A disposable lighter, comprising:

a mounting frame disposed on a lighter body for receiving a liquefied fuel therein having a gas valve which is actuated by a gas lever pivotally mounted on said mounting frame for actuating said gas valve to release said liquefied fuel within said lighter body, wherein said mounting frame comprises a first and second supporting walls parallelly extended upwardly at opposite sides of said gas lever; and an ignition device comprising:

a flint supported by a resilient element;

a striker wheel having a circumferential coarse striking surface positioned right above said flint being rotatably mounted between said first and second supporting walls by means of a wheel axle, and two driving wheels coaxially mounted on two sides of said striker wheel respectively, wherein each of said driving wheels has a circumferential teeth surface and a diameter larger than a diameter of said striker wheel; and a child resistant device which comprises a pair of shelter wheels each including a protection disc having a center hole and a shelter ring integrally and transversally extended from a circumferential edge of said protection disc so as to define a U-shaped cross section for each of said shelter wheels, wherein said two shelter wheels are coaxially and firmly mounted at two sides of said two driving wheels by securely passing said two wheel axles through said two center holes of said two protection discs respectively, wherein an inner diameter of said shelter ring is larger than an outer diameter of said driving wheels so as to define a safety gap between an inner circumferential surface of said shelter ring and said circumferential teeth surface of each of said driving wheels, wherein each of said two shelter rings has a width shorter than a thickness of each of said driving wheels and said two shelter rings of said two shelter wheels are substantially extended to partially cover said circumferential teeth surfaces of said two driving wheels respectively so as to define an actuating edge at an uncovered portion of said circumferential teeth surface of each of said driving wheels, wherein said two shelter wheels are positioned at two outer sides of said driving wheels respectively, wherein said shelter rings are extended towards said striker wheel to cover said circumferential teeth surfaces of said two driving wheels respectively such that said two actuating edges are formed at two inner edge portions of said circumferential teeth surfaces of said two driving wheels respectively.

2. The disposable lighter, as recited in claim 1, wherein each said center hole of said protection discs having a polygon shape has a size slighter smaller than a diameter of said wheel axle in such a manner that when said wheel axle passes through said center hole, a circumferential edge of said center hole is forced to distort a shape thereof so as to fit to said wheel axle.

3. The disposable lighter, as recited in claim 1, wherein each said center hole of said protection discs having a polygon shape has a size slighter smaller than a diameter of said wheel axle in such a manner that when said wheel axle passes through said center hole, a circumferential edge of said center hole is forced to distort a shape thereof so as to fit to said wheel axle.

4. The disposable lighter, as recited in claim 1, wherein each said center hole of said protection discs having a saw-toothed shape has a size slighter smaller than a diameter of said wheel axle in such a manner that when said wheel axle passes through said center hole, a circumferential edge of said center hole is forced to distort a shape thereof so as to fit to said wheel axle.

5. The disposable lighter, as recited in claim 1, wherein each of said shelter rings has an outer smooth circumferential surface for reducing a friction thereof.

6. The disposable lighter, as recited in claim 2, wherein each of said shelter rings has an outer smooth circumferential surface for reducing a friction thereof.

7. The disposable lighter, as recited in claim 3, wherein each of said shelter rings has an outer smooth circumferential surface for reducing a friction thereof.

8. The disposable lighter, as recited in claim 4, wherein each of said shelter rings has an outer smooth circumferential surface for reducing a friction thereof.

* * * * *